United States Patent [19]

Jung

[11] Patent Number: 5,075,525

[45] Date of Patent: Dec. 24, 1991

[54] WAVE SHIELDING DEVICE FOR MICROWAVE OVEN

[75] Inventor: Kwan J. Jung, Pusan, Rep. of Korea

[73] Assignee: Goldstar Co., Ltd., Seoul, Rep. of Korea

[21] Appl. No.: 542,712

[22] Filed: Jun. 25, 1990

[51] Int. Cl.[5] ..... H05B 6/76

[52] U.S. Cl. ..... 219/10.55 D; 174/35 GC

[58] Field of Search ..... 219/10.55 D; 174/35 GC, 174/35 R

[56] References Cited

U.S. PATENT DOCUMENTS

| | | | |
|---|---|---|---|
| 4,584,447 | 4/1986 | Kusunoki et al. | 219/10.55 D |
| 4,659,891 | 4/1987 | Yamaguchi et al. | 219/10.55 D |
| 4,689,460 | 8/1987 | Ishino et al. | 219/10.55 D |
| 4,700,034 | 10/1987 | Lee | 219/10.55 D |
| 4,742,201 | 5/1988 | Nakano et al. | 219/10.55 D |

FOREIGN PATENT DOCUMENTS

| | | | |
|---|---|---|---|
| 1-82486 | 3/1989 | Japan | 219/10.55 D |

*Primary Examiner*—Philip H. Leung

*Attorney, Agent, or Firm*—Birch, Stewart, Kolasch & Birch

[57] ABSTRACT

A microwave leakage shielding device for a microwave oven includes a seal plate integrally formed with a slit and having a bent surface disposed at a flange by coupling of the flange and the bent surface of the seal plate for obtaining a first shielding effect, a tuning post member having a certain period based on a TE mode wherein there exists no electric field in the direction of the wave direction for obtaining a second shielding effect, a choke seal disposed in the damping groove for obtaining a third shielding effect, and a capacitive seal formed by coupling of the bent surface of the door frame and the flange for obtaining a fourth shielding effect, whereby the microwave leakage shielding device exhibits an excellent shielding capability and is convenient in assembling with the microwave oven.

3 Claims, 2 Drawing Sheets

FIG. 1
PRIOR ART
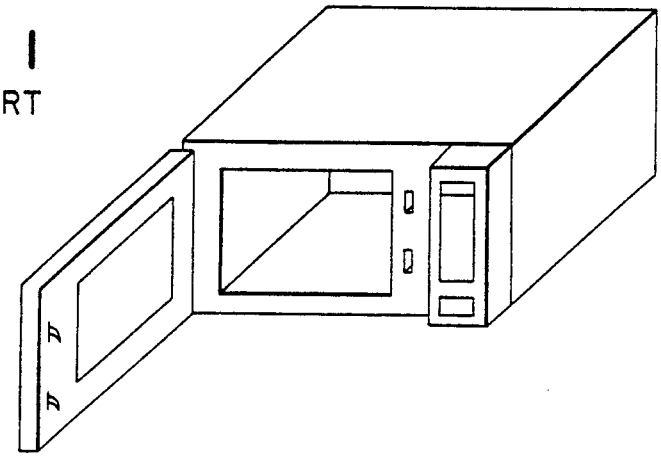
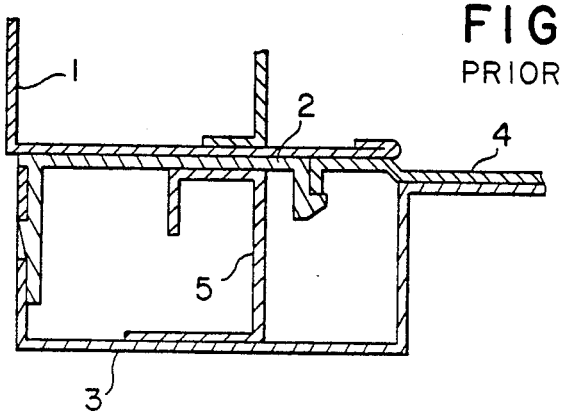
FIG. 2
PRIOR ART
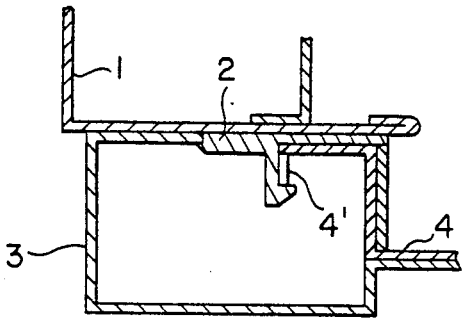
FIG. 3
PRIOR ART
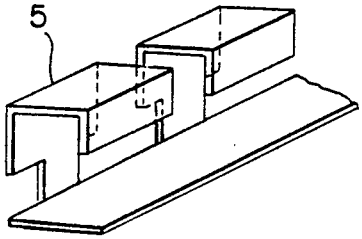
FIG. 4
PRIOR ART

WAVE SHIELDING DEVICE FOR MICROWAVE OVEN

BACKGROUND OF THE INVENTION

1. Field of the Invention

The present invention relates to a microwave shielding device for use in a microwave oven and more particularly, to a microwave leakage shielding device for use in a door of a microwave oven for improving the wave shielding capability thereof so that the microwave oven is refined in appearance and the microwave shielding device is easy in assembling.

2. Description of the Prior Art

Generally, the conventional microwave shielding devices include two types such as a slit installing type as shown in FIG. 2 and a seal plate-slit combination type as shown in FIG. 3.

As shown in FIG. 2, the conventional shielding device includes an installing slit 5 provided in a door frame 3 in order to form a choke seal and dual metals formed by coupling a seal plate 4 with a flange 1 which is peripheral edge of the entrance opening of the heat chamber thereby forming a structure for shielding the leaking waves. Furthermore, the slit installing type includes a first choke seal and a second choke seal in addition to the dual metals. Thus a first microwave leakage shielding effect is obtained by the coupling of the dual metals and a second microwave leakage damping effect is obtained through the first choke seal and the second choke seal.

As shown in FIG. 3, the conventional shielding device includes the seal plate 4 integrally formed with a slit 4, of the seal plate 4 for serving as a tuning post member through the combination of the slit 4,, the choke seal, and the dual metals. Thus a first microwave leakage damping effect is obtained through the slit 4,, a second microwave leakage damping effect is obtained through the formation of the choke seal, and a third microwave leakage damping effect is obtained through the coupled metals thereby forming a triple shielding structure.

However, in the device of FIG. 2, a space has to be formed within the door frame 3 since the installing slit 5 has to be formed within the door frame 3. Therefore, the size of the door frame has to expand and if the installing slit 5 is not provided at the proper position in the door frame 3, the leakage damping cannot be obtained.

Furthermore, in the device of FIG. 3, it is very difficult to install the choke cover and when the door is opened, the choke cover is too much exposed to the outside thereof thereby aggravating the aesthetic appearance of the microwave oven.

SUMMARY OF THE INVENTION

Accordingly, it is an object of the present invention to provide a microwave shielding device for a microwave oven for overcoming the above described disadvantages of the conventional devices.

Another object of the present invention is to provide an improved microwave leakage shielding device for use in a door of a microwave oven for improving the microwave shielding capability so as to be refined in appearance and convenient in assembling.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a microwave leakage shielding device for a microwave oven includes a seal plate integrally formed with a slit and having a bent surface disposed at a flange by coupling of the flange and the bent surface of the seal plate for obtaining a first shielding effect, a tuning post member having a certain period based on a TE mode wherein there exists no electric field in the direction of the wave direction for obtaining a second shielding effect, a choke seal dispose damping groove for obtaining a third shielding effect, and a capacitive seal formed by coupling of the bent surface of the door frame and the flange for obtaining a fourth shielding effect, whereby the microwave leakage shielding device exhibits an excellent shielding capability and is convenient in assembling with the microwave oven.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a perspective view of a conventional microwave oven;

FIG. 2 is a sectional view of a door of the conventional slit installing type microwave oven;

FIG. 3 is a sectional view of a door of the conventional seal plate-slit combination type microwave oven;

FIG. 4 is a perspective view of a slit of FIG. 2;

DESCRIPTION OF THE PREFERRED EMBODIMENTS

Figure 5:
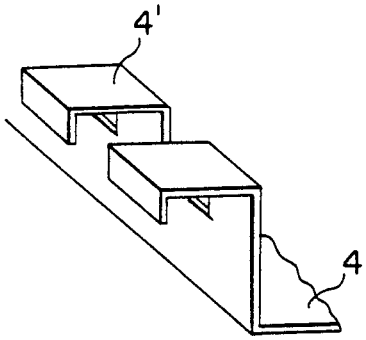
FIG. 5 PRIOR ART
FIG. 5 is a perspective view of a slit of FIG. 3.
Figure 6:
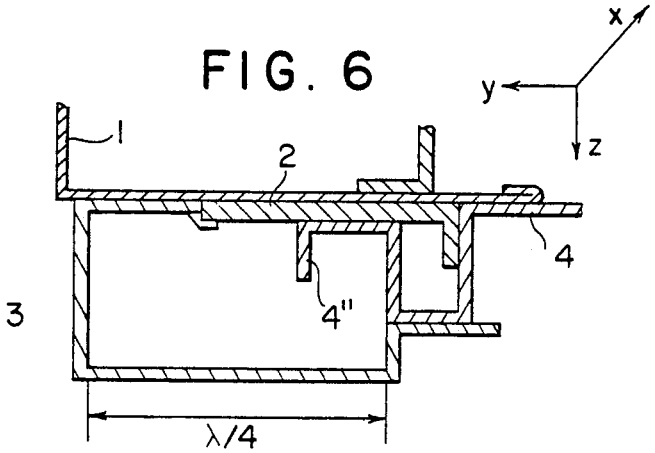
FIG. 6 is a sectional view of the microwave leakage shielding device for use in the door of the microwave oven according to the present invention.
Figure 7:
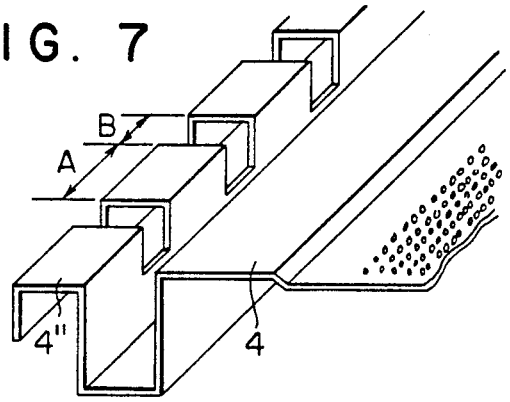
FIG. 7 is a perspective view of a slit of FIG. 6.
Figure 8:
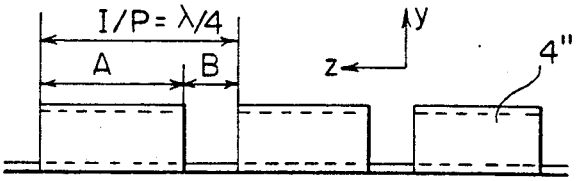
FIG. 8 is a front view of the microwave leakage shielding device according to the present invention.

Referring now in detail to the drawings for the purpose of illustrating preferred embodiments of the present invention, the microwave leakage shielding device for use in a microwave oven as shown in FIGS. 6, 7, and 8, comprises a tuning post 4" integrally formed with a seal plate 4 and disposed in a damping groove of a door frame 3. The cross-sectional diagram is shown in FIG. 8. The seal plate is bent to form U-shaped configuration for having a seal cavity. The slit 4" has extending portions A and a disconnecting intervals B wherein the A+B has to have a certain period $\lambda/4(1P-\lambda/4)$.

Furthermore, a choke, cover 2 has an L-shaped configuration for covering over the tuning post 4" and the choke cover 2 is disposed between the door frame 3 and the seal plate 4 wherein one or more damping grooves has to be formed within the door frame 3.

The microwave leakage shielding device according to the present invention operates as follows:

First microwave leakage damping effect is obtained through the structure that the seal plate 4 integrally having the tuning post 4" is bent and the upper surface of the seal plate 4 is connected to a flange 1.

Second microwave leakage damping effect is obtained by providing a tuning post member which has a certain period in accordance with a TE mode.

Third microwave leakage damping effect is obtained by forming a choke seal in the damping groove.

Fourth microwave leakage damping effect is obtained by forming a capacitive seal obtained by contacting two metals since the door frame 3 has a bent surface.

The λ/4 which is the period of the tuning post 4'' serving as the tuning post member is determined by the TE mode. The TE mode is indicative of a mode wherein there exists no electric field in the direction of the wave advancement.

Under the TEmn mode, the distributions of the electric fields in the x and y directions are represented by the following formulas:

$$\Sigma_x = \sum_{m=o}^{\infty}\sum_{n=o}^{\infty}\frac{j\omega\mu\eta\pi}{Kc^2\cdot b}Hmn\mathrm{Cos}\left(\frac{m\pi}{a}x\right)\mathrm{Sin}\left(\frac{n\pi}{b}y\right)e^{-jBgZ} \quad (1)$$

$$\Sigma_y = \sum_{m=o}^{\infty}\sum_{n=o}^{\infty}\frac{j\omega\mu\eta\pi}{Kc^2\cdot a}Hmn\mathrm{Sin}\left(\frac{m\pi}{a}x\right)\mathrm{Cos}\left(\frac{n\pi}{b}y\right)e^{-jBgZ} \quad (2)$$

where $kc^2$ represents $(m^{90}/a)^2+(n^{90}/b)^2$, $\beta$ g represents $\sqrt{k^2-kc^2}$, $k^2$ represents $\omega^2\epsilon\mu$, and Hmn represents an arbitrary constant.

From the above definitions as shown in formulas (1) and (2), the following relations can be derived.

$$\lambda c\ (\text{Cut-off wave length}) = 2/\sqrt{(m/a)^2+(n/b)^2} \quad (3)$$

$$\lambda c\ (\text{Guided wave length}) = \lambda/\sqrt{1-(\lambda/\lambda c)^2} \quad (4)$$

wherein m and n represent the electric fields in the x and y directions and λ represents the wave length in the free space.

The conditions $\lambda<\lambda$ c and $\lambda g>\lambda$ have to be met for a microwave of an arbitrary period to be transmitted through.

The propagation velocity/frequency for $\lambda=1$ second is $$\frac{300000\ \text{km}}{2450\ \text{MHZ}} = 122\ \text{mm}$$

and therefore, $\lambda/4=122/4=30.5$.

As shown in FIG. 7, the A serves as the tuning post and its position can be established as follows from the formulas 1, 2, and 4.

$$E_y = Ec\cdot\sum_{m=o}^{\infty}\mathrm{Sin}(m\pi/a\cdot x) \quad (5)$$

wherein, Eo is a constant.

Based on the above formula (5), the position is decided at a point where the electric field in the direction of X is the maximum and the point where the electric field is the maximum can be obtained by differentiating the formula 5.

That is, the maximum electric field point lies at $Ey'=0$.

$$E_y' = \cos\left(\frac{m\pi}{a}\cdot x\right) = o\cdot\frac{m\pi}{a}\cdot x = \frac{n\pi}{2}$$

$$(N = 1, 3, 5, -2m-1),\ x = \frac{N\cdot a}{2m}$$

Thus the point where X equals to is the point where the electric field is the maximum. Therefore, the proper tuning post member is established at this point so that the propagation of the waves can be most effectively inhibited.

Accordingly the microwave leakage shielding device of the present invention can be expected a quadruple shielding effect thereby forming a superior shielding structure.

That is, the microwave propagated in all directions are shielded in an effective manner and the structure does not require any separate attaching member.

Therefore, the installing of the choke cover is very convenient while the aesthetic appearance of the microwave oven is kept in a decent form.

The invention being thus described, it will be obvious that the same may be varied in many ways. Such variations are not to be regarded as a departure from the spirit and scope oft he invention, and all such modifications as would be obvious to one skilled in the art are intended to be included in the scope of the following claims.

What is claimed is:

1. In a microwave oven of the type having an internal heating chamber, which chamber has an entrance opening in one face thereof, an irradiating means for supplying microwave energy to the heating chamber, the microwave energy having both a fundamental frequency and higher order harmonics thereof, and a door movably attached to the heating chamber and adapted to cover completely the entrance opening of the heating chamber when the door is in a closed position, a microwave leakage shielding device comprising:

the heating chamber having a metallic flange surrounding the entrance opening, the door having first and second juxtaposed choke sealing cavities formed therein and having a common wall therebetween, the common wall including a series of tuning posts and intervening spaces therebetween, the series of tuning posts and spaces having a periodicity based upon a TE mode for obtaining microwave leakage damping effects.

the first, outermost choke sealing cavity having a width of about ¼ of the wavelength of the fundamental frequency of the microwave energy for preventing leakage of the fundamental frequency of the microwave energy from the microwave oven, the second, innermost choke sealing cavity having a width substantially less than ¼ of the wavelength of the fundamental frequency of the microwave energy for preventing the leakage of the higher order harmonics of the microwave energy from the microwave oven, and the door also having first and second metallic surfaces thereon each of which makes surface-to-surface contact with the metallic flange on the heating chamber when the door is in the closed position to form first and second capacitive seals therebetween to prevent leakage of microwave energy from the microwave oven, the first capacitive seal being at the periphery of the door and the second capacitive seal being disposed inwardly of the second choke sealing cavity, whereby the microwave leakage shielding device exhibits an excellent capability for preventing leakage of microwave energy from the microwave oven because four separate microwave leakage shielding effects are combined and which is convenient to assemble into the microwave oven while maintaining a pleasing appearance for the microwave oven.

2. A microwave oven according to claim 1, wherein the periodicity of the series of tuning posts is equal to $\frac{1}{4}$ of the fundamental frequency of the microwave energy and wherein the tuning posts are wider than the spaces therebetween.

3. A microwave oven according to claim 2, wherein the door further includes a choke cover disposed over the first and second choke sealing cavities to cooperate in achieving a quadruple shielding effect.

* * * * *